US010603243B2

(12) United States Patent
Scott et al.

(10) Patent No.: US 10,603,243 B2
(45) Date of Patent: Mar. 31, 2020

(54) ERGONOMIC GRIP AND AXILLA FOR WALKING AID DEVICES

(71) Applicant: Applied Mobility Devices, LLC, Estero, FL (US)

(72) Inventors: William Scott, Estero, FL (US); Joseph Cuiffi, Pittsburgh, PA (US)

( * ) Notice: Subject to any disclaimer, the term of this patent is extended or adjusted under 35 U.S.C. 154(b) by 0 days.

(21) Appl. No.: 15/868,956

(22) Filed: Jan. 11, 2018

(65) Prior Publication Data

US 2019/0183716 A1 Jun. 20, 2019

Related U.S. Application Data

(60) Provisional application No. 62/444,912, filed on Jan. 11, 2017, provisional application No. 62/444,921, filed on Jan. 11, 2017, provisional application No. 62/444,923, filed on Jan. 11, 2017.

(51) Int. Cl.
*A61H 3/02* (2006.01)

(52) U.S. Cl.
CPC ..... *A61H 3/02* (2013.01)

(58) Field of Classification Search
CPC ..... A61H 3/02; A61H 2003/025
USPC ..... 135/66, 68
See application file for complete search history.

(56) References Cited

U.S. PATENT DOCUMENTS 2,197,279 A * 4/1940 Thorssen ..... A61H 3/02 135/71
2,362,642 A * 11/1944 Lamb ..... A61H 3/02 135/73
3,174,494 A * 3/1965 Maguire, Jr. ..... A61H 3/02 135/68
3,269,399 A * 8/1966 Smith ..... A61H 3/02 135/72
4,625,743 A * 12/1986 Harker ..... A61H 3/02 135/68
4,637,414 A * 1/1987 Urban ..... A61H 3/02 135/73
6,059,697 A * 5/2000 Breems ..... A61H 3/02 135/68
7,537,017 B2 * 5/2009 Baker ..... A61H 3/02 135/68
7,591,275 B2 * 9/2009 Baker ..... A61H 3/02 135/68
8,800,579 B2 * 8/2014 Severson ..... A61H 3/02 135/72

(Continued)

*Primary Examiner* — Noah Chandler Hawk
(74) *Attorney, Agent, or Firm* — Patent Service Associates; Lyman Smith

(57) ABSTRACT

Mobility aid devices, such as crutches, provide improved ergonomics, comfort and support for the user. The crutches can include an axilla support that has a shape with a peak that fits in the center of the user's axilla area, an increased width for the pad area in the peaked region, a feature that curves upward and toward the user's back to prevent forward slippage of the axilla support, and a feature that includes upward curves or widened areas to prevent rearward slippage of the axilla support. The crutches can include a grip that has a wider rear portion when viewed from the top, a downward slope from rear to front, a front area that narrows and twists towards the outside from horizontal, an offset from the centerline of the crutches to the outside and a rear that is rotated outward from the support centerline when viewed from the top.

11 Claims, 10 Drawing Sheets

(56) References Cited

U.S. PATENT DOCUMENTS

| | | | | |
|---|---|---|---|---|
| 9,320,671 | B2 * | 4/2016 | Gelfand | A61H 3/02 |
| 9,358,176 | B1 * | 6/2016 | Vaeth | A61H 3/02 |

* cited by examiner

ERGONOMIC GRIP AND AXILLA FOR WALKING AID DEVICES

CROSS-REFERENCE TO RELATED APPLICATIONS

This application claims the benefit of priority of U.S. provisional patent application No. 62/444,912, filed Jan. 11, 2017, U.S. provisional patent application No. 62/444,921, filed Jan. 11, 2017 and U.S. provisional patent application No. 62/444,923, filed Jan. 11, 2017, the contents of each of which are herein incorporated by reference.

BACKGROUND OF THE INVENTION

1. Field of the Invention

One or more embodiments of the invention relates generally to mobility aid devices. More particularly, the invention relates to an ergonomic grip and axilla support for walking aid devices, such as crutches.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

For all the extraordinary technological advances made in medical devices over the past half century, crutches (including axilla and forearm styles) and canes have fallen dangerously behind. The basic design of standard crutches, canes and walkers hasn't changed for decades, going back to when the first medical advice given to new patients was "take it easy and go slow." Unstable, uncomfortable, inflexible and unattractive at best, their design actually impedes a user's return to max-mobility potential. It also contributes to something most mobility device designers don't think about: the loss of dignity the user feels at having to rely on these archaic devices in the first place.

First, they're uncomfortable and fatiguing. This not only limits the time a patient is able to use them but also puts stress on the hands, wrists, forearms, neck and back, which can lead to upper back ailments and other physical disorders, such as rotator cuff tears.

Second, because they so poorly conform to the body's natural physiology, they're awkward to maneuver and thus inherently unstable. This especially applies to children and adolescents, the elderly, the overweight, the out-of-shape and/or those who have been prescribed painkillers or other medications—which covers just about all of us. The result is often a loss of balance and an awkward, nasty fall that can reinjure the patient or cause new trauma to the head, wrists, ankles and other areas of the body.

These devices have for years been associated with discomfort and instability. What hasn't been addressed up to now is their basic inflexible, "static" nature. That is, they've been designed to accommodate a patient at his/her initial (and therefore worst) point of pain and discomfort; they aren't designed to "adjust" as the user heals and desires greater mobility. This disadvantage actually retards the recovery of the user who's capable of moving more freely than the device will accommodate.

Not to be overlooked, these stark, Spartan-like devices, which put users in slumped over, clumsy-looking positions, almost seem purposely designed to make the user feel self-conscious and even stigmatized. Nothing about how they look—nor how they make the tottering user look when trying to stay upright—lends dignity to the patient.

Over recent years, however, medical professionals have learned that the key to rapid recovery from surgery, injury or any incident impacting mobility is to get patients up and walking as naturally as their pain will allow, as quickly as possible. Put it all together and medical professionals who must prescribe the use of these particular mobility aids actually find themselves unintentionally violating their sacred oath "to do no harm."

Referring to FIG. 1, standard crutches 100 have an axilla support 102 that is flawed. The axilla support 102 is the upper component of the crutch that fits into the axilla (armpit) area. A crutch user will often note that the axilla support 102 has two common problems: 1) it is uncomfortable, pinching the nerves and tendons at the front and rear of the axilla area, and 2) it often slips out of the axilla area, causing instability. These problems, especially the first one, have led to numerous after-market pads and supports, further indicating problems with the very common standard design.

Moreover, referring additionally to FIG. 2, standard axilla crutch grips 104 are fundamentally designed incorrectly, with a focus on simple manufacturability rather than ergonomics. First, the simple cylindrical design is actually most effective for pulling force. In other words, a grip where a user wraps their hand around a cylinder is typically used where a pulling motion is required (e.g., chin up bar). When used in an application where a pushing force is required, as in crutches, the cylindrical grip 104 causes the hand 106 to rotate because of the offset in the force 108 from the forearm. This effect is further aggravated by the centerline of the grip 104 being placed in the center of the crutch supports 110. This requires that the arm goes outward from the axilla 102 and then inward to grab the grip 104. This causes premature tiring of the arm/hand and provides a non-stable grip and poor force transfer to the crutch from the user.

In view of the foregoing, there is a need for an improved mobility aid device that addresses various design flaws found in conventional crutches.

SUMMARY OF THE INVENTION

Embodiments of the present invention provide an axilla support for a mobility aid device comprising a front and a rear support pole receptacle for supporting the axilla support; and a concave peak disposed at a location between the rear support pole receptacle and a centerline located equidistant from the front and rear support pole receptacles.

In some embodiments, the axilla support includes an increased width region located at a location between the rear support pole receptacle and a centerline located equidistant from the front and rear support pole receptacles, the increased width region having a width greater than a portion of the axilla support forward the centerline.

In some embodiments, the axilla support includes a rear fin at a rear end of the axilla support, the rear fin curving inward toward a user's back when the mobility is used by a user, the rear fin further curving upward, thereby preventing forward slippage of the axilla support during use thereof.

In some embodiments, the rear fin includes at least one slot configured to receive a strap therein for interconnecting a pair of the mobility aid devices.

In some embodiments, the axilla support further comprises a front end having a bulge with an increased width and an upward curve, thereby preventing rearward slippage of the axilla support during use thereof.

Embodiments of the present invention further provide a grip for a mobility aid device comprising a front and a rear support pole position, wherein at least one of the front and rear support pole positions supporting the grip; a rear portion of the grip having a width greater than a width of a front portion thereof; a downward slope of a top portion of the grip from the rear portion to the front portion; and a front area having a decreased width and a twist toward an outside portion of the grip.

In some embodiments, the grip includes an offset between a grip centerline drawn between the front and rear support pole positions and a grip centerline, wherein the offset is directed toward the outside portion of the grip.

Embodiments of the present invention also provide a mobility aid device, comprising front and rear support poles; an axilla support comprising a front and a rear axilla support pole receptacle for supporting the axilla support on the front and rear support poles, a concave peak disposed at a location between the rear support pole receptacle and a centerline located equidistant from the front and rear support pole receptacles; and a grip comprising a front and a rear support pole position, at least one of the front and the rear support pole positions supporting the grip, a rear portion of the grip having a width greater than a width of a front portion thereof, a downward slope of a top portion of the grip from the rear portion to the front portion, and a front area having a decreased width and a twist toward an outside portion of the grip.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
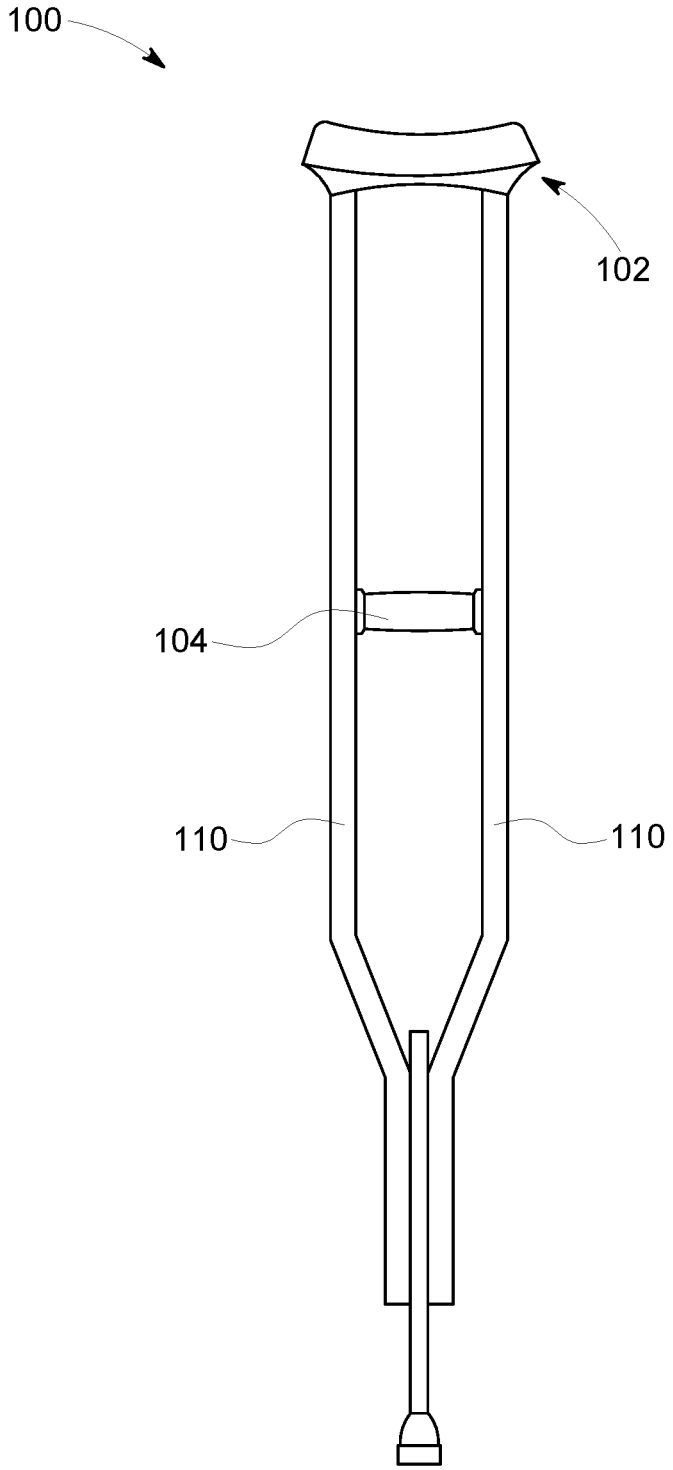
FIG. 1 (PRIOR ART)
FIG. 1 is a side view of a conventional crutch.
Figure 2:
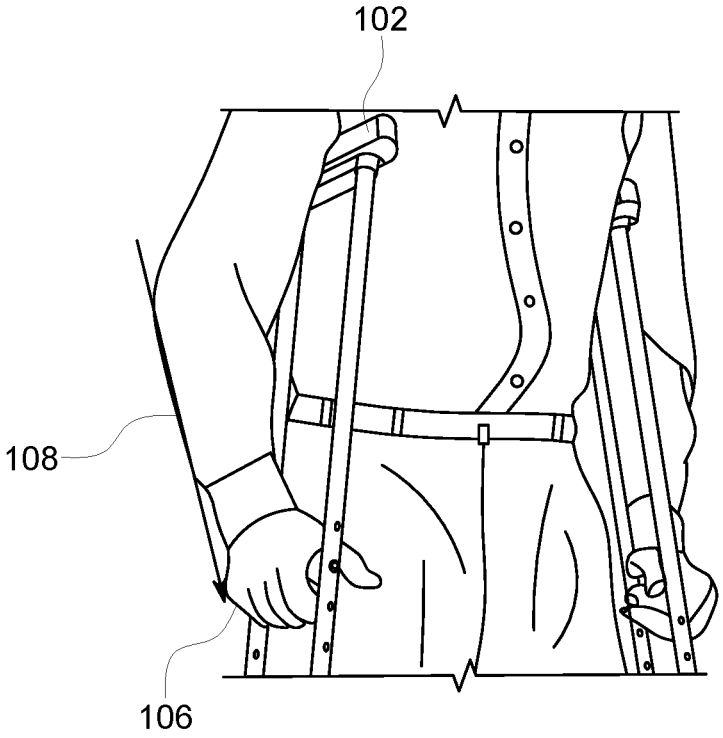
FIG. 2 (PRIOR ART)
FIG. 2 is a perspective view of a user using the conventional crutch of FIG. 1.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide mobility aid devices, such as crutches, that provide improved ergonomics, comfort and support for the user. The crutches can include an axilla support that has a shape with a peak that fits in the center of the user's axilla area, wherein the peak is located in the position between the centerline of the support poles and the rear support pole, an increased width for the pad area in the peaked region, a feature in the rear of the support that curves upward and toward the user's back to prevent forward slippage of the axilla support, and a feature in the front of the support that includes upward curves or widened areas to prevent rearward slippage of the axilla support. The crutches can include a grip that has a wider rear portion of the grip, when viewed from the top, a downward slope from rear to front, a front area that narrows and twists towards the outside from horizontal, an offset from the centerline of the walking aid supports to the outside and a rear that is rotated outward from the support centerline when viewed from the top. These features may be used alone or in various combinations to provide the mobility aid devices according to various embodiments of the present invention.

Referring now to FIGS. 3 through 6, a mobility aid device, such as a crutch 10 can include an axilla support 12 that addresses the two common problems of conventional crutches, as noted above, and provides an improved overall ergonomic fit.

Figure 3:
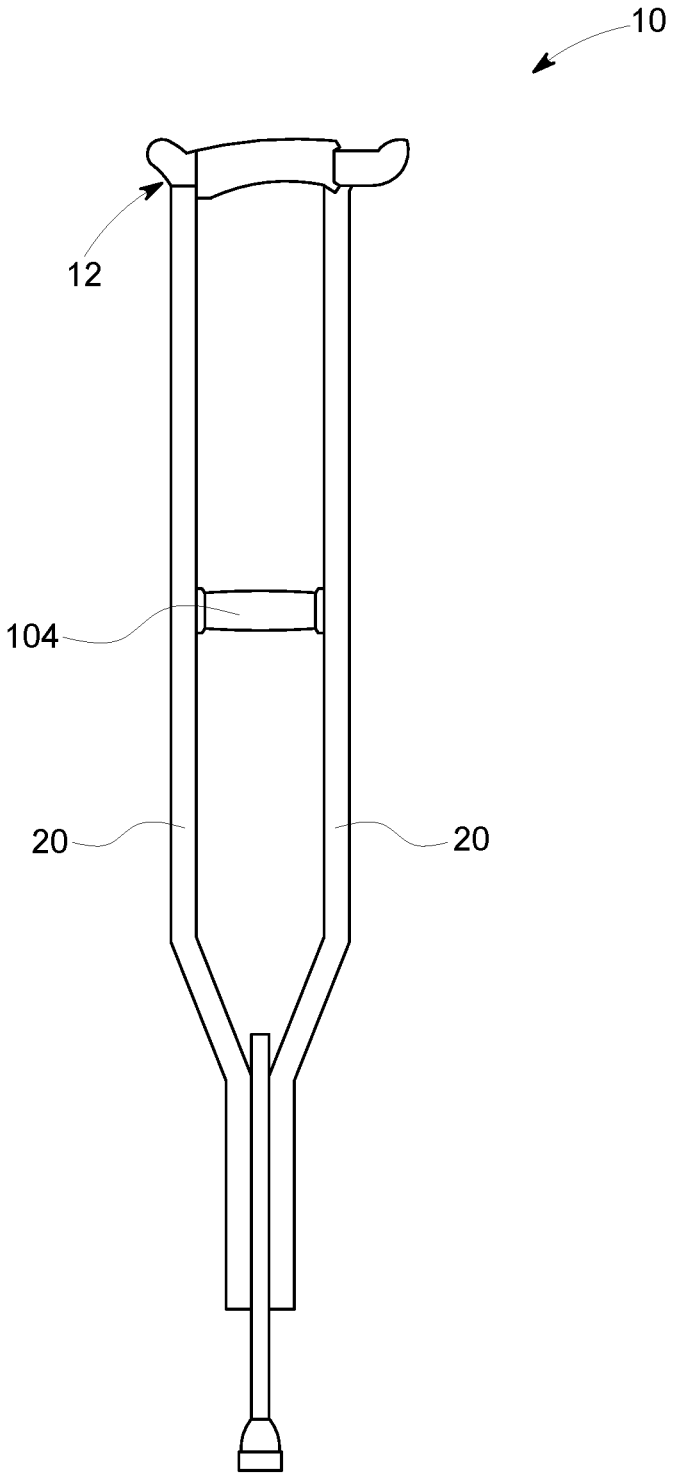
FIG. 3 is a side view of a crutch having an improved axilla support according to an exemplary embodiment of the present invention.
Figure 4:
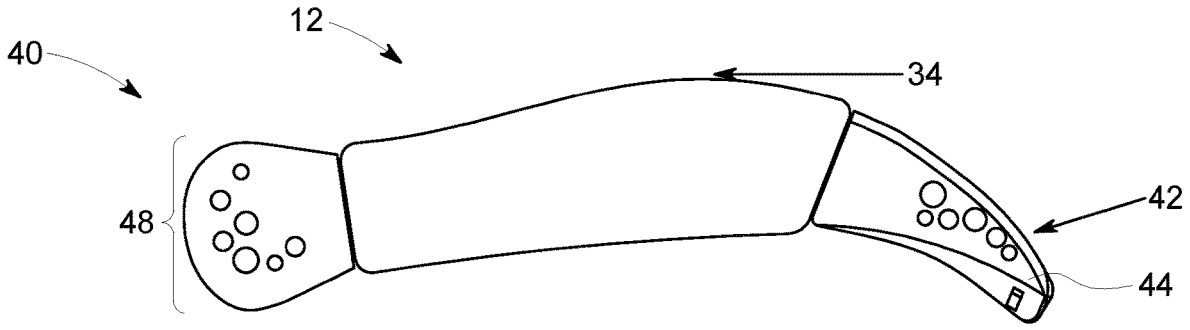
FIG. 4 is a top view of the axilla support of FIG. 3.
Figure 5:
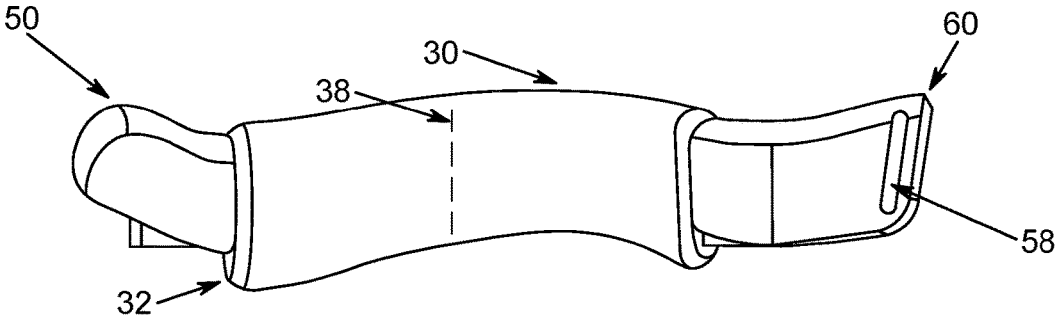
FIG. 5 is an inner side view of the axilla support of FIG. 3.
Figure 6:
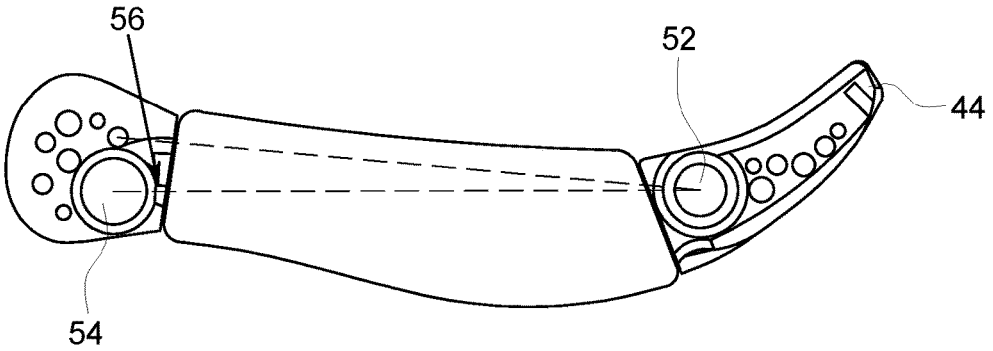
FIG. 6 is a bottom view of the axilla support of FIG. 3.

The first problem, an uncomfortable and often painful fit in the axilla area of the user, is corrected with one or more aspects of the structure of the axilla support 12 as detailed in FIGS. 4 through 6. In the axilla support 12, a first feature is a convex (instead of concave) design, shown in the side view of FIGS. 3 and 5, which is opposite of a standard axilla support 102 (see FIG. 1), that has a peak 30, not a valley in the axilla area. A pad 32 is provided here, but the primary comfort improvement is dictated by the shape change. In the axilla (armpit) area, nerves and tendons are located at the front and rear of the axilla area, with a soft portion in the middle. The design of the axilla support 12 according to embodiments of the present invention provides center support in the soft middle area of the axilla, reducing pressure on the front and rear areas. A wider rear section 34, shown in the top view, also helps to alleviate pressure by spreading contact over a larger surface area. The wider rear section 34 may range from about 30 mm to about 50 mm in width for maximum comfort and usability (including rotation of the crutch). If this section is too wide, the user's arm will not fit over the shape comfortably, but if it is too thin, the support and pressure reduction may be reduced. The center pad peak 30, again as noted on the side view of FIG. 5, is positioned towards the rear of a centerline 38 between the two crutch support poles 20. This accommodates the natural position of the axilla (armpit) area towards the rear one of the support poles 20. This peak 30 is best positioned at a position between the centerline 38 and the rear one of the support poles 20, depending on the grip position and other crutch frame design components.

The second problem, an axilla support and crutch that slips out from the user's axilla area, is addressed with features at a front 40 of the axilla support 12 and a rear 42 of the axilla support 12. At the rear 42 of the support, FIGS. 4 and 6 best show a fin 44 that curves towards the user. The fin 44 is designed to wrap around the back of the user slightly during use of the crutch 10. The curved fin 44, including the upward curve on a top portion 46 of the fin 44 to form a rear peak 60, as best seen in FIGS. 3 and 5, prevents the axilla support 12 from slipping forward during crutch operation. This can be further enhanced with the use of a retention strap (not shown) around the user connected to the axilla area via, for example, a slot 58 formed in the rear 42 of the axilla support 12.

To prevent the axilla support 12 from slipping towards the rear of the user, shapes at the front of the component work in a similar fashion to the rear. FIGS. 4 and 6 best show a bulge 48 at the front 40, both widened when viewed from the top, as shown in FIGS. 3 and 5, and having a peak 50 when viewed from the side. This acts to catch on the user's arm or chest if the axilla support 12 begins to slip rearward. The shape here may vary, and may be some combination of upward peak 50 and widened bulge 48 to provide the effect.

Another feature of the axilla support 12 of the present invention addresses overall user ergonomics. Best seen from the bottom view in FIG. 6, the overall angle of the axilla support 12 turns outward from the rear support pole receptacle 52. First, the support rear pole receptacle 52 is positioned as close to the user (inside of the axilla support 12) as possible. Then, the front 40 is rotated outward, by placing the front support pole receptacle 54 towards the outside. This angle, refined through testing, provides a more natural crutch angle with respect to the body, especially in combination with an ergonomic grip. This angle optimally varies from 2-7 degrees from a pole-pole centerline 56 of the crutch 10.

Figure 13:
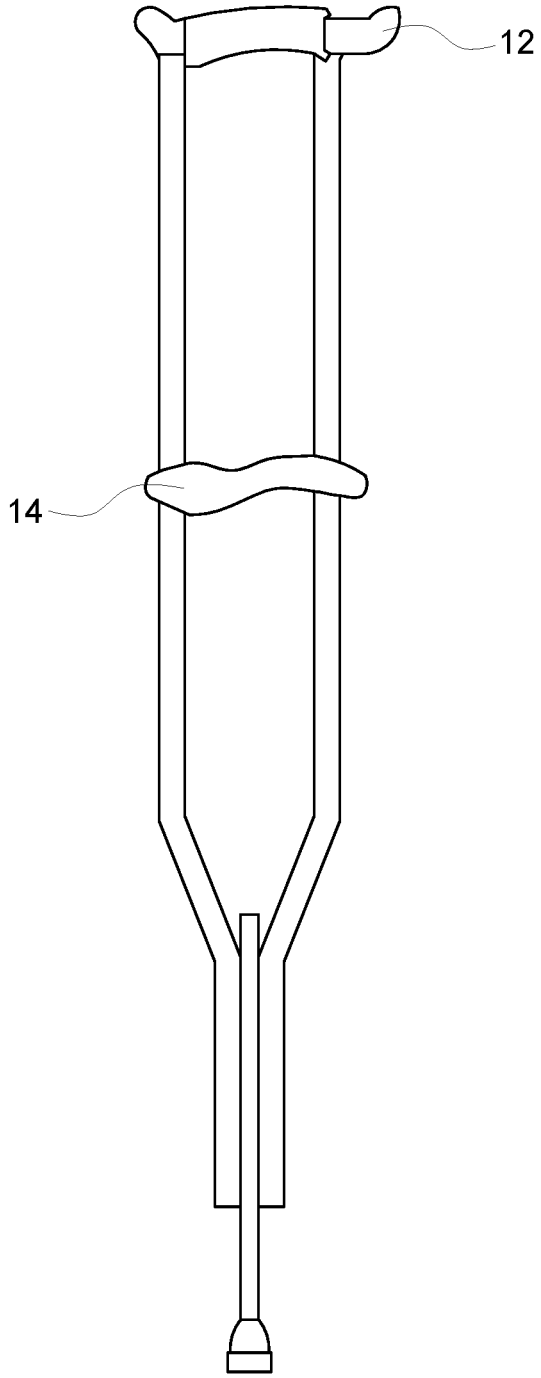
FIG. 13 is a side view of a crutch having both the improved axilla support of FIG. 3 and the improved grip of FIG. 7.

FIG. 3 shows the axilla support 12 used with a conventional crutch handle 104. However, in some embodiments, an improved crutch grip 14, as described below, may be used with the axilla support 12, as shown in FIG. 13, or may be used with a conventional axilla support 102, as described above and as shown in FIG. 7.

The axilla support 12 may provide a user with the ability to rest a portion of their weight thereupon. Unlike conventional crutches, which instruct users not to use the axilla support for weight bearing at all, the axilla support 12, with its design as described above and as claimed, can support a user without inflicting pain and/or nerve damage as may be the case with conventional crutches.

Figure 7:
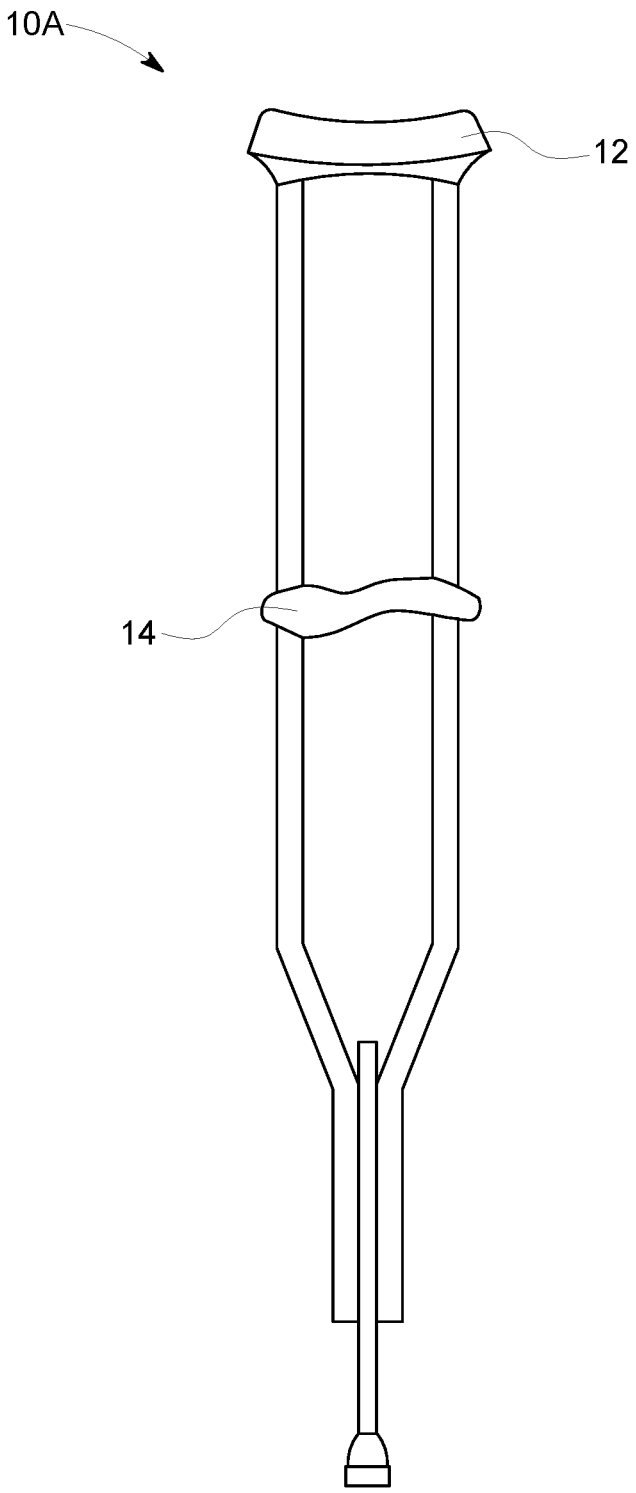
FIG. 7 is a side view of a crutch having an improved grip according to an exemplary embodiment of the present invention.
Figure 8:
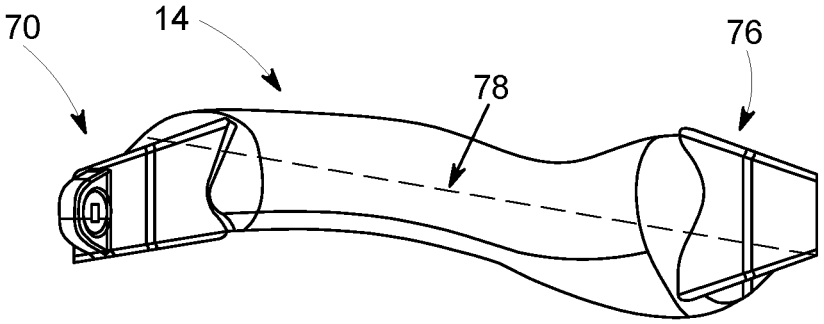
FIG. 8 is an inner side view of the grip of FIG. 7.

Referring now to FIGS. 7 through 12, a grip 14, according to embodiments of the present invention, addresses the inadequacies of a standard walking aid grip 104 (see FIG. 1) related to ergonomics and control of the walking aid. While FIG. 7 illustrates the grip 14 used with a standard axilla crutch 10A, it may be used on other walking aids such as canes, walkers, walking sticks and other devices.

Figure 9:
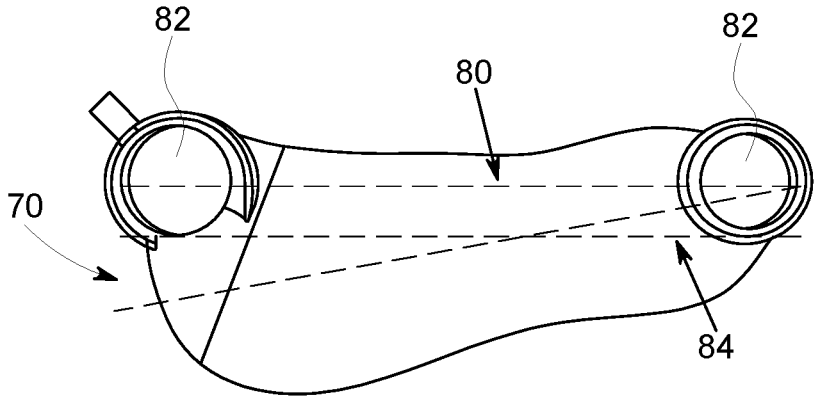
FIG. 9 is a top view of the grip of FIG. 7.
Figure 10:
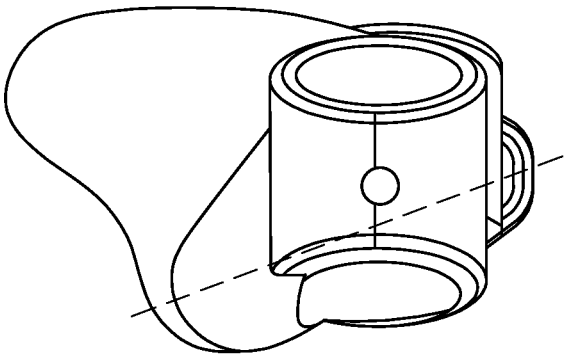
FIG. 10 is a front view of the grip of FIG. 7.

Ergonomic grips vary in their shape, but the grip 14 according to embodiments of the present invention is focused on mobility aids. The following features, which may be incorporated individually or in their entirety, are included in the grip 14. The grip 14 may be wider in a rear 70 of the grip 14, which acts as a pad for a rear palm portion 72 of a user's hand 74. The grip 14 may slope downward, rear 70 to front 76, as shown by line 78 in FIG. 8. The front 76 may narrow, as best shown in FIG. 9, and twist towards the outside of the grip 14 as best shown in FIG. 10. An offset between the centerline 80 of the walking aid (crutch) supports 82 and the centerline 84 of the grip 14 is toward the outside of the grip, as best shown in FIG. 9. The rear 70 of the grip 14 that is rotated outward from the support centerline 80.

It should be understood that the walking aid supports 82 are shown in the Figures as front and rear frame receptacles. However, in some embodiments, these positions may simply be locations, as the grip 14 may be supported by only one crutch support 82, as in the case of a cane, for example.

Specifics that distinguish the grip 14 of the present invention from other ergonomic grips include the combination of the listed features and the following characteristics. The slope from rear to front (as illustrated by line 78 in FIG. 8) is designed to distribute weight evenly in the hand. This slope may be between about 5 to about 15 degrees from horizontal. The twist from rear (horizontal) to front ranges between about 10 to about 30 degrees from horizontal, as shown in FIG. 10. The overall angle of the grip 14, where the rear portion 70 is rotated outward with respect to the front as viewed form the top in FIG. 9, ranges between 5-15 degrees from the support centerline 80. The overall position (centerline 84) of the grip 14 is offset outward from the support centerline 80, ranging from about 5 to about 35 mm, as shown in FIG. 9.

Figure 11:
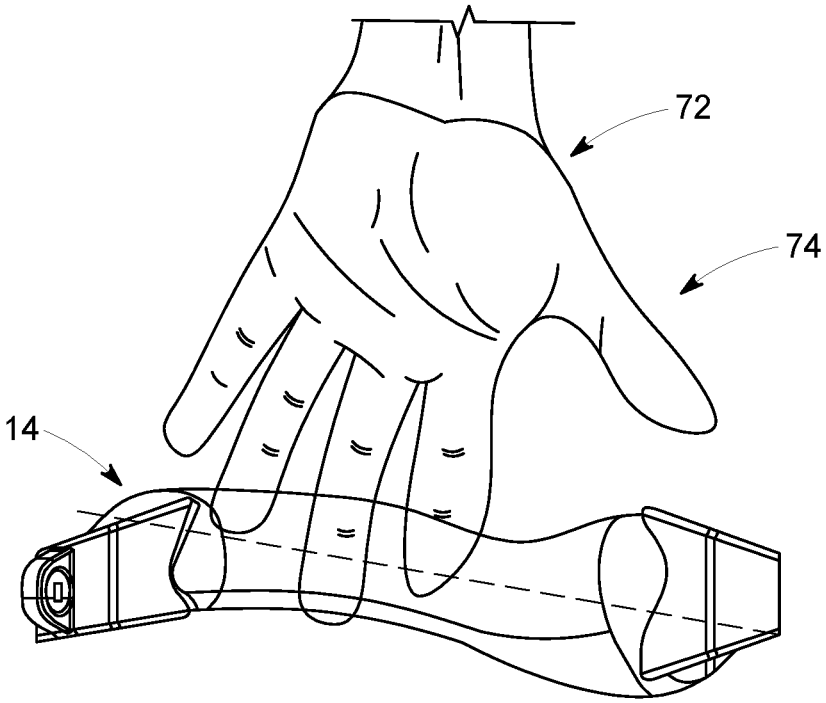
FIG. 11 is a top view of the grip of FIG. 7, illustrating how the angles of the grip aligns with a more natural hand position.
Figure 12:
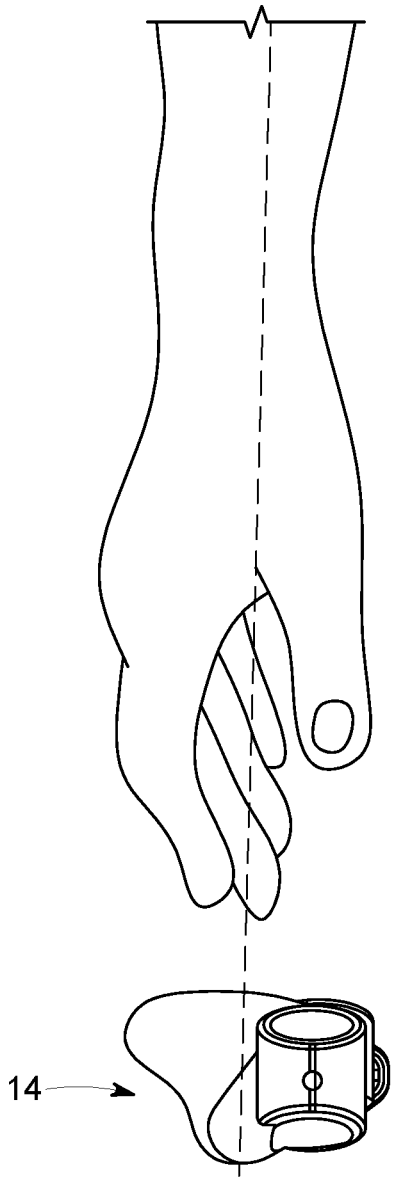
FIG. 12 is a front view of the grip of FIG. 7, illustrating how the forearm is aligned with the bulk of the grip.

These features, used in combination improve the grip on the mobility aid by reducing pressure points on the palm, creating a better line of force through the forearm to the mobility aid, and creating a more ergonomic push-style grip. FIGS. 11 and 12 show hand position in relation to the grip. It is shown that the shape of the grip allows for a grip similar to a handshake, where the forefinger is pointed downward at the front of the grip and the rear part of the grip supports the pads in the palm. With the angle and offsets, the forearm position is better lined up with the pressure areas in the grip, allowing for more solid downforce. The rotation of the hand is eliminated, and in fact, through testing, it was noted that the fingers don't need to curl around the grip to hold on to the grip. It was also noted in testing that the user felt increased confidence, stability, and less fatiguing when compared to a traditional grip.

Figure 14:
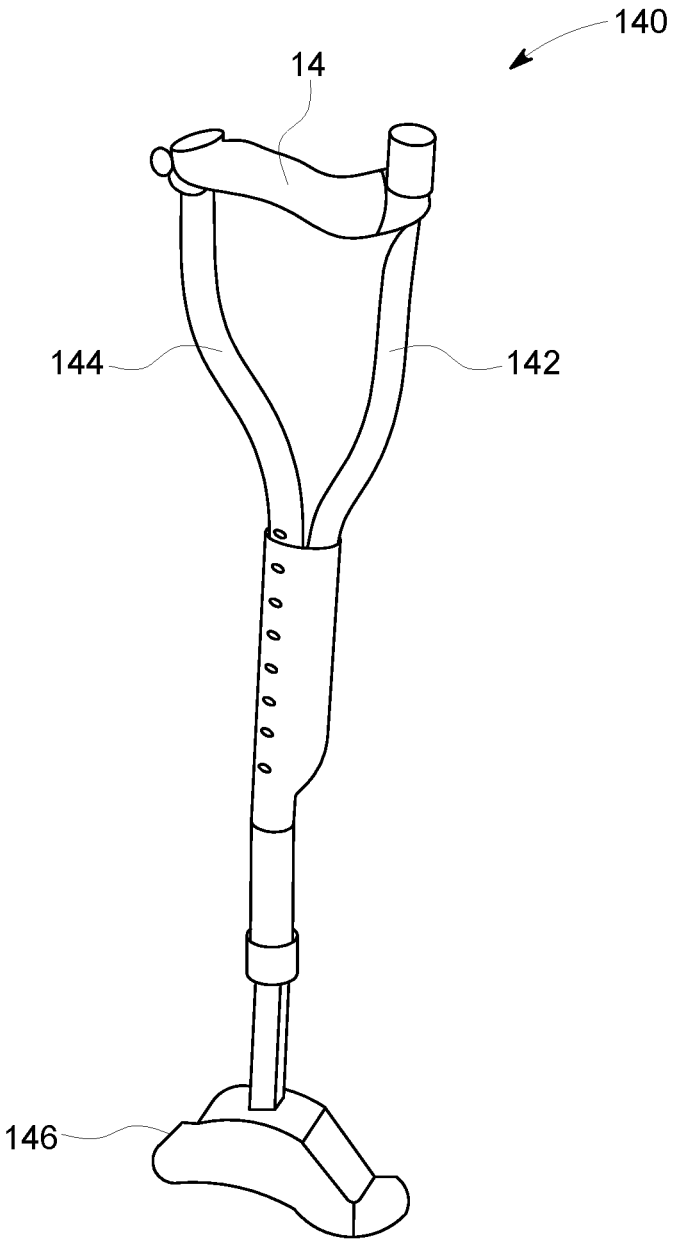
FIG. 14 is a perspective view of a cane style mobility aid device having the improved grip of FIG. 7.

Referring to FIG. 14, as described above, the inventive grip 14 may be used on various products, such as crutches, as shown above and in a cane 140, as shown in FIG. 14. The cane 140 can include a first cane support leg 142 and a second cane support leg 144 that support the grip 14. In some embodiments, the first cane support leg 142 may be omitted and the grip 14 may be supported by a single leg.

A foot 146 may be present as described in U.S. patent application Ser. No. 15/868,956, entitled "Dynamic Foot Support for Mobility Aid Devices", the contents of which are herein incorporated by reference. Moreover, the axilla support and grip may be used with various types of mobility aid devices, including those described in commonly-owned, concurrently filed U.S. patent application Ser. No. 15/868,969, entitled "Frame Configuration for Mobility Aid Devices", and Ser. No. 15/868,967, entitled "Link Support for Walking Aid Devices", the contents of which are herein incorporated by reference.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A mobility aid device, comprising:

front and rear support poles;

an axilla support comprising:

a front and a rear axilla support pole receptacle for supporting the axilla support on the front and rear support poles;

a concave peak disposed at a location between the rear support pole receptacle and a centerline located equidistant from the front and rear support pole receptacles; and a grip comprising:

a front and a rear support pole position, at least one of the front and the rear support pole positions supporting the grip;

a rear portion of the grip having a width greater than a width of a front portion thereof;

a downward slope of a top portion of the grip from the rear portion to the front portion; and a front area having a decreased width and a twist toward an outside portion of the grip, wherein the axilla support further comprises a rear fin at a rear end of the axilla support, the rear fin curving inward toward a user's back when the mobility is used by a user, the rear fin further curving upward, thereby preventing forward slippage of the axilla support during use thereof; and the rear fin includes at least one slot configured to receive a strap therein fot interconnecting a pair of the mobility aid devices.

2. The mobility aid device of claim 1, wherein the axilla support further comprises a front end having a bulge with an increased width and an upward curve, thereby preventing rearward slippage of the axilla support during use thereof.

3. The mobility aid device of claim 1, wherein the grip further comprises an offset between a grip centerline drawn between the front and rear support pole receptacles and a grip centerline, wherein the offset is directed toward the outside portion of the grip.

4. The mobility aid device of claim 3, wherein the offset outward from the grip centerline is from about 5 mm to about 35 mm.

5. The mobility aid device of claim 1, further comprising an increased width region located at a location between the rear support pole receptacle and a centerline located equidistant from the front and rear support pole receptacles, the increased width region having a width greater than a portion of the axilla support forward the centerline.

6. The mobility aid device of claim 5, wherein the increased width region has a width between about 35 mm and about 50 mm.

7. The mobility aid device of claim 1, wherein an angle of the axilla support with respect to a centerline drawn between the front and rear support pole receptacles is from about 2 degrees to about 7 degrees, with a front end of the axilla support angled inward toward the user during use of the mobility aid device.

8. The mobility aid device of claim 1, wherein the rear portion is rotated outward from a centerline of the grip.

9. The mobility aid device of claim 1, wherein the downward pe from rear to front is between about 5 degrees to about 15 from horizontal.

10. The mobility aid device of claim 1, wherein the rotation outward of the rear portion is from about 10 degrees to about 30 degrees.

11. The mobility aid device of claim 1, wherein an overall angle of the grip, where the rear portion is rotated outward with respect to the front as viewed form a top side thereof, ranges between about 5 degrees and about 15 degrees from a grip centerline.

* * * * *